US010031444B2

(12) United States Patent
Akita

(10) Patent No.: US 10,031,444 B2
(45) Date of Patent: Jul. 24, 2018

(54) DEVELOPMENT DEVICE AND IMAGE FORMING APPARATUS

(71) Applicant: CANON KABUSHIKI KAISHA, Tokyo (JP)

(72) Inventor: Masanori Akita, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/481,658

(22) Filed: Apr. 7, 2017

(65) Prior Publication Data

US 2017/0299985 A1 Oct. 19, 2017

(30) Foreign Application Priority Data

Apr. 14, 2016 (JP) ..... 2016-080908

(51) Int. Cl.
*G03G 9/083* (2006.01)
*G03G 15/06* (2006.01)
*G03G 15/10* (2006.01)

(52) U.S. Cl.
CPC ..... *G03G 15/104* (2013.01); *G03G 9/083* (2013.01); *G03G 15/06* (2013.01); *G03G 2215/0658* (2013.01)

(58) Field of Classification Search
CPC ... G03G 15/104; G03G 15/06; G03G 15/0609
See application file for complete search history.

(56) References Cited

U.S. PATENT DOCUMENTS 4,844,008 A * 7/1989 Sakemi ..... G03G 15/09 399/270
6,330,415 B1 * 12/2001 Imamura ..... B82Y 15/00 399/277
7,027,760 B2 * 4/2006 Enoki ..... G03G 13/09 399/267
8,571,449 B2 10/2013 Miyoshi et al.
8,750,752 B2 6/2014 Miyoshi et al.
(Continued)

FOREIGN PATENT DOCUMENTS

JP H05-72886 A 3/1993
JP 2007-304142 A 11/2007
(Continued)

*Primary Examiner* — Gregory H Curran
(74) *Attorney, Agent, or Firm* — Fitzpatrick, Cella, Harper & Scinto

(57) ABSTRACT

A development device includes a developer bearing member and a magnet which is fixed inside of the developer bearing member. The magnet includes a first magnetic pole for developing a latent image, a second magnetic pole adjacent to the first magnetic pole and being an opposite pole to the first magnetic pole, and a third magnetic pole adjacent to both the first and second magnetic poles and having an opposite pole to the first magnetic pole. A developer regulation portion is disposed such that when a maximum peak amount of a magnetic flux density of the first magnetic pole in a normal direction of the developer bearing member is defined as positive, the magnetic flux density of the first magnetic pole becomes positive in an entire region from a downstream side of the regulating member in a rotary direction of the developer bearing member and through a developing area.

3 Claims, 10 Drawing Sheets

(56) References Cited

U.S. PATENT DOCUMENTS

| | | | |
|---|---|---|---|
| 8,971,769 | B2 | 3/2015 | Miyoshi et al. |
| 9,304,446 | B2 | 4/2016 | Akita et al. |
| 2015/0234323 | A1 | 8/2015 | Furukawa et al. |
| 2017/0068188 | A1 | 3/2017 | Akita et al. |

FOREIGN PATENT DOCUMENTS

| | | | |
|---|---|---|---|
| JP | 2010-204639 | A | 9/2010 |
| JP | 2012-155008 | A | 8/2012 |

* cited by examiner

FIG. 10

| | DENSITY RANK | IMAGE QUALITY RANK (NORMAL ENVIRONMENT) | IMAGE QUALITY RANK (HIGH-HUMIDITY ENVIRONMENT) |
|---|---|---|---|
| PRESENT EMBODIMENT ($\arctan(Br/B\theta)=45°$) | 5 | ○ | ○ |
| COMPARATIVE EXAMPLE A ($\arctan(Br/B\theta)=20°$) | 4 | ○ | △ |
| COMPARATIVE EXAMPLE B ($\arctan(Br/B\theta)=10°$) | 2 | △ | × |
| COMPARATIVE EXAMPLE C | 1 | × | × |

DEVELOPMENT DEVICE AND IMAGE FORMING APPARATUS

BACKGROUND OF THE INVENTION

Field of the Invention

The present invention relates to a development device that is adaptable to an image forming apparatus using an electrophotographic image forming process, such as a laser beam printer, a copying machine, or a facsimile device, and an image forming apparatus.

Description of the Related Art

Conventionally, a two-component development system using a mixture of non-magnetic toner and magnetic carriers as a developer has widely been used in an image forming apparatus using toner as a developer.

With the two-component development system described above, a developer is carried on the surface of a development sleeve due to magnetic force of a magnet roller stored in the development sleeve (developer bearing member), and the amount of the carried developer is regulated by a development blade to form a thin developer layer on the development sleeve. Then, this developer layer is conveyed to a development region facing a photosensitive drum due to the rotation of the development sleeve, and electrostatically adsorbed on the photosensitive drum with the developer being napped in a brush chain due to the magnetic force of the magnet roller. Thus, an electrostatic latent image is developed.

It has been known that, due to the uniformization in the density of the developer layer conveyed to the development region, the contact state between the developer and the photosensitive drum is made uniform to enhance image quality. Therefore, a configuration for making the density of the developer layer uniform has conventionally been proposed.

Japanese Patent Laid-Open No. 2012-155008 discloses the configuration in which the amount of developer carried on a development sleeve is regulated by a first development blade, and a developer layer is compressed by a second development blade disposed at the downstream of the first development blade with respect to the rotation direction of the development sleeve to thereby make the density of the developer layer uniform.

However, in the configuration disclosed in Japanese Patent Laid-Open No. 2012-155008, the amount of developer has already been regulated by the first development blade before the developer layer is compressed by the second development blade. Therefore, to make the density uniform by compressing the developer layer under this condition, high precision is required in the arrangement of the second development blade. That is, if the second development blade is disposed to be closer to the development sleeve, the developer is accumulated at the upstream side of the second development blade to cause overflow of the developer. On the other hand, in being far away from the development sleeve, the second development blade is not in contact with the development sleeve, so that the effect of regulation cannot be obtained.

SUMMARY OF THE INVENTION

It is desirable to provide a development device that can implement enhancement in uniformity in magnetic brushes in a development region.

A representative configuration of the present invention is a development device that develops an electrostatic latent image formed on an image bearing member, the development device including:

a developer bearing member that carries a developer including magnetic particles and is rotatable;

a magnet that is stored in the developer bearing member and has a development pole for developing the electrostatic latent image formed on the image bearing member; and a regulation portion that is disposed to face the developer bearing member for regulating an amount of developer carried on the developer bearing member, wherein the regulation portion is disposed such that, when a magnetic flux density of the development pole in the normal direction with respect to a surface of the developer bearing member is defined as positive, a magnetic flux density becomes positive in the entirety of a region which is upstream of a development region where the developer and the image bearing member are in contact with each other so as to develop the electrostatic latent image formed on the image bearing member and which is downstream of the regulation portion in a rotation direction of the developer bearing member.

Further features of the present invention will become apparent from the following description of exemplary embodiments with reference to the attached drawings.

BRIEF DESCRIPTION OF THE DRAWINGS

FIG. 10 is a table showing the result of an experiment conducted for comparing the state of the density of the developer layer to be conveyed to a development region and image quality when a halftone image is output.

DESCRIPTION OF THE EMBODIMENTS

First Embodiment

<Image Forming Apparatus>

Hereinafter, the overall configuration of an image forming apparatus A according to the present invention will firstly be described together with the operation during the image formation. The image forming apparatus A according to the present embodiment is a full-color image forming apparatus of an electrophotographic system that forms an image onto a sheet S with toner of four colors, yellow Y, magenta M, cyan C, and black K.

The image forming apparatus A includes an image forming portion that forms a toner image and transfers the toner image onto the sheet S, a sheet feed portion that feeds the sheet S to the image forming portion, and a fixing portion that fixes the toner image onto the sheet S.

Figure 1:
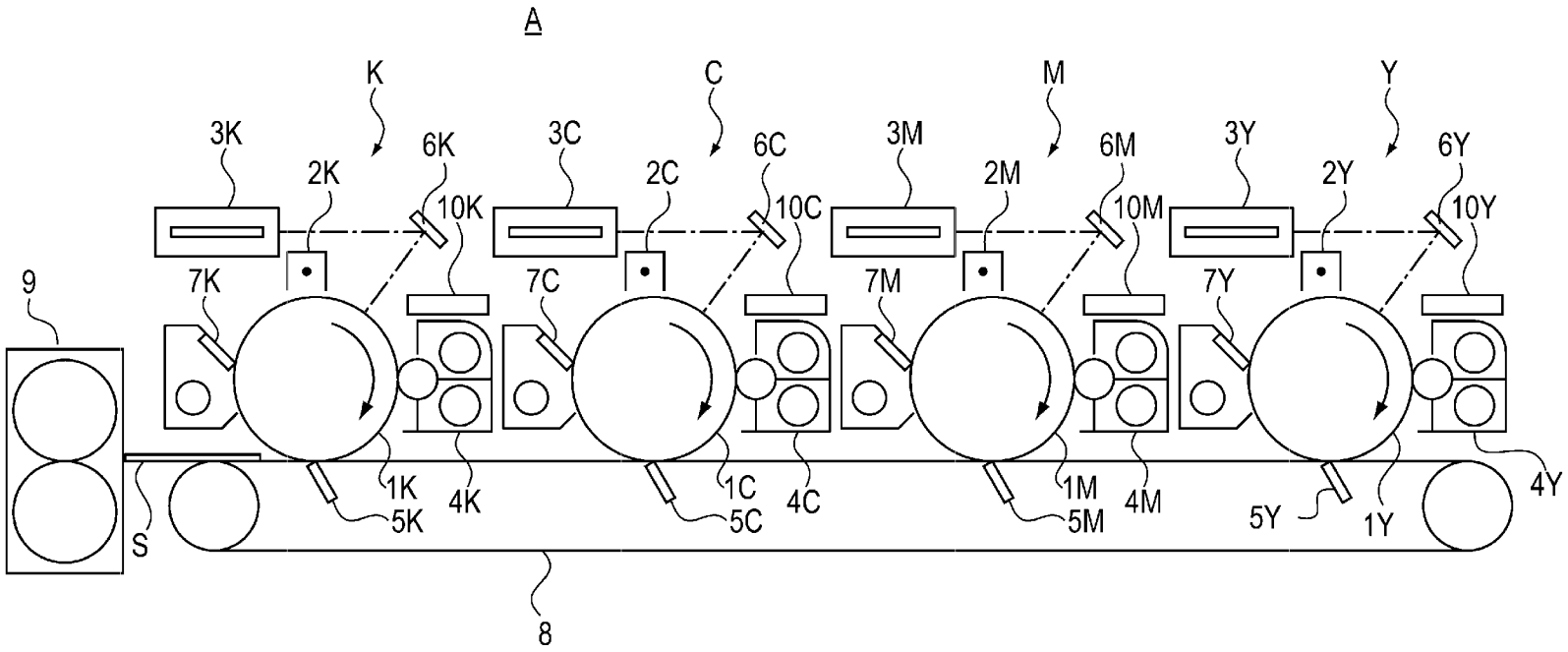
FIG. 1 is a schematic sectional view of an image forming apparatus.

As illustrated in FIG. 1, the image forming portion includes a photosensitive drum 1 (1Y, 1M, 10, 1K) mounted so as to be rotatable and serving as an image bearing member, and a charging member 2 (2Y, 2M, 2C, 2K) that charges the photosensitive drum 1. The image forming portion also includes a laser scanner unit 3 (3Y, 3M, 3C, 3K), a development device 4 (4Y, 4M, 4C, 4K), a transfer member 5 (5Y, 5M, 5C, 5K), and the like.

In the image formation, when a controller which is not illustrated receives an image formation job, the sheet S stacked on a sheet stacking portion which is not illustrated is fed to the image forming portion.

In addition, in the image forming portion, the photosensitive drum 1 is uniformly charged by the charging member 2. Then, the laser scanner unit 3 emits laser light, which has been modulated according to an image information signal, from a light source not illustrated, and the surface of the photosensitive drum 1 is irradiated with the laser light through a mirror 6 (6Y, 6M, 6C, 6K), whereby an electrostatic latent image is formed:

Then, the electrostatic latent image formed on the photosensitive drum 1 is made visible as a toner image by the development device 4. Thereafter, the toner image is transferred onto the sheet S conveyed by a conveyance belt 8 through application of a bias having a polarity opposite to the charging polarity of toner to the transfer member 5 (transfer portion). Then, the sheet S is conveyed to a fixing device 9 where heat and pressure are applied to the sheet S, whereby the toner image is fixed onto the sheet S. The sheet S is then discharged to the outside of the image forming apparatus A.

Note that the developer remaining on the photosensitive drum 1 after the transfer is removed by a cleaning device 7 (7Y, 7M, 7C, 7K). In addition, toner in the developer consumed by the image formation is supplied from a supply path not illustrated by a toner supply tank 10 (10Y, 10M, 100, 10K).

Further, while the present embodiment is configured to directly transfer an image onto a sheet from the photosensitive drum 1, the present invention is not limited thereto, and may be configured such that, after toner images of respective colors are primarily transferred onto an intermediate transfer member, and then, a composite toner image of each color is secondarily transferred onto a sheet collectively.

<Development Device>

Subsequently, the configuration of the development device 4 will be described.

Firstly, a developer used for development by the development device 4 will be described. In the present embodiment, a two-component developer is used as the developer which contains non-magnetic toner and magnetic carriers (magnetic particles), the toner and the carriers being mixed in a mixing weight ratio (toner weight÷weight ratio of toner and carriers) of 8%.

The toner contains binder resin and a colorant, and contains, as needed, colored resin particles containing other additives or colored particles to which external additives such as colloidal silica fine powders are added. The toner is negatively chargeable polyester resin, and in the present embodiment, the toner having a volume average particle diameter of 7.0 μm is used.

For the carriers, surface-oxidized or non-oxidized iron, nickel, cobalt, manganese, chrome, metal such as rare earth and alloy thereof, and oxide ferrite can be used, for example, and the method for preparing the magnetic particles is not particularly limited. In the present embodiment, carriers having a volume average particle diameter of 40 μm, resistivity of $5\times10^8$ Ωcm, and magnetization of 180 emu/cc are used.

Note that the magnetization of the magnetic carriers can be within the range of 100 to 300 emu/cc. The reason for this is as follows. Specifically, when the magnetization becomes less than or equal to 100 emu/cc, the magnetic restraint force between the development sleeve 26 bearing the developer and the carriers is decreased, so that the carriers are likely to be deposited onto the photosensitive drum 1. On the other hand, when the magnetization becomes more than or equal to 300 emu/cc, the rigidity of the developer layer carried on the development sleeve 26 increases, so that a sort of brush irregularities is likely to occur on the image due to the sliding friction of the developer layer.

Figure 2:
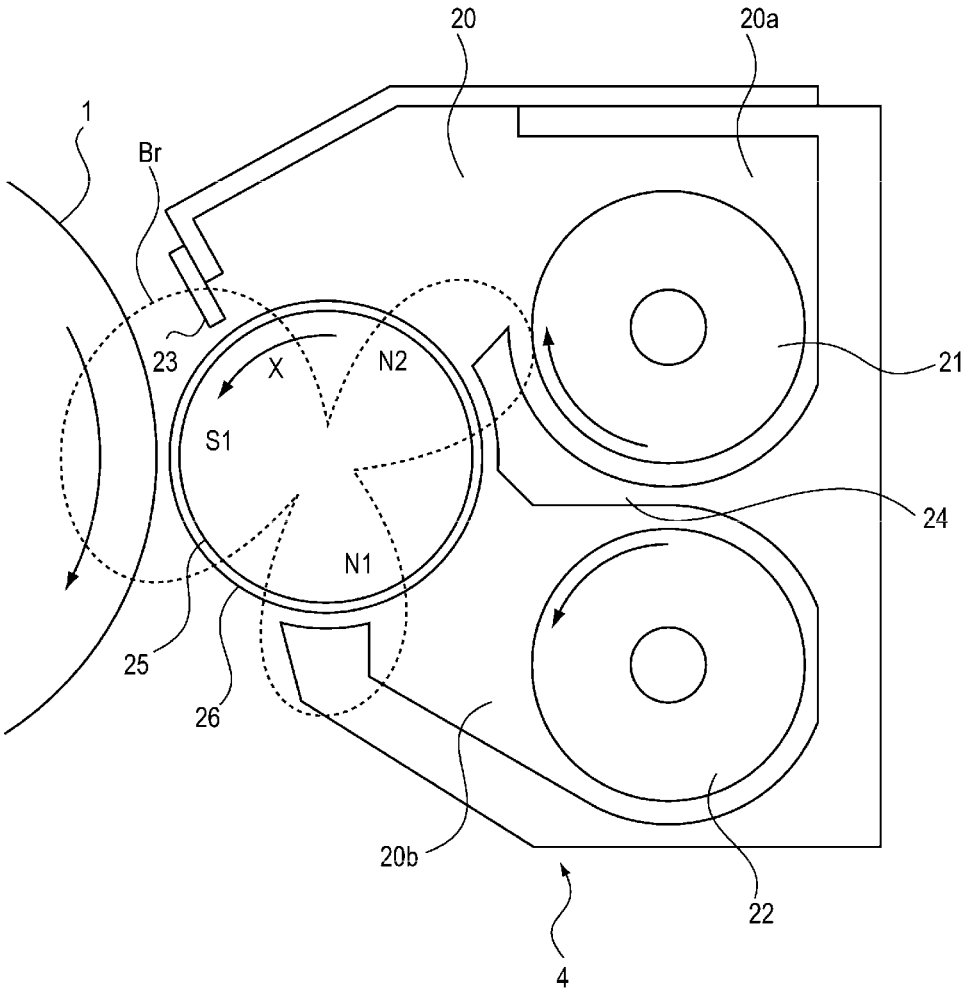
FIG. 2 is a schematic sectional view of a development device in the transverse direction.

Next, the internal structure and the basic operation of the development device 4 will be described. FIG. 2 is a sectional view of the development device 4 in the transverse direction, and FIG. 3 is a sectional view thereof in the longitudinal direction.

Figure 3:
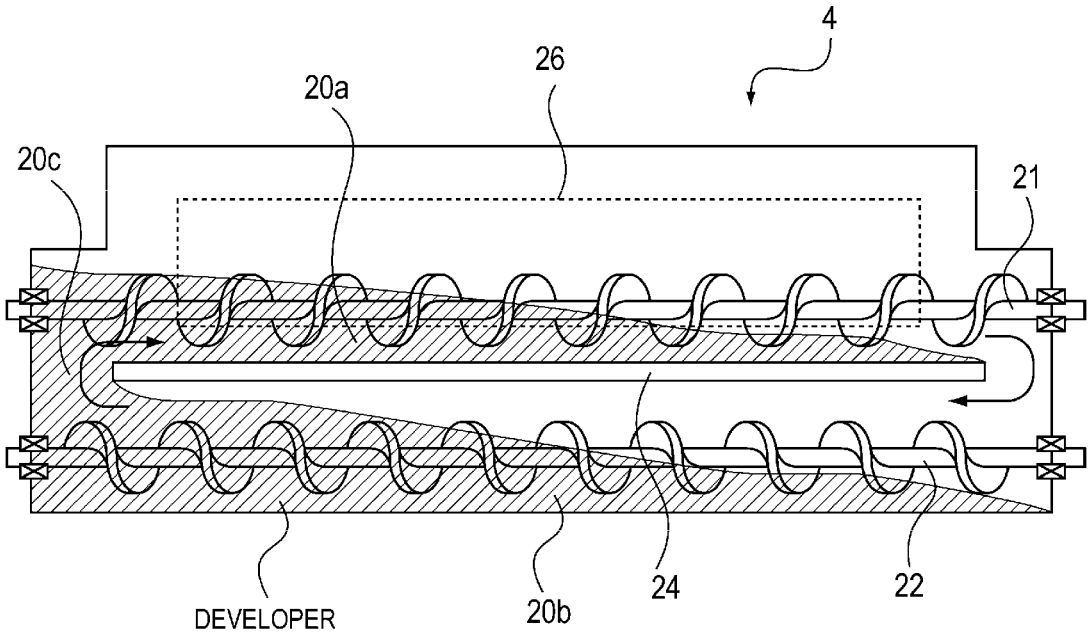
FIG. 3 is a schematic sectional view of the development device in the longitudinal direction.

As illustrated in FIGS. 2 and 3, the development device 4 has a developer storing portion 20 that stores a developer. The developer storing portion 20 is provided with a partition wall 24 inside, and vertically divided into an upper part which is a development chamber 20*a* and a lower part which is a stirring chamber 20*b* across the partition wall 24.

The development chamber 20*a* and the stirring chamber 20*b* are respectively provided with a first conveyance screw 21 and a second conveyance screw 22 for conveying the developer while stirring. The first conveyance screw 21 is disposed on the bottom of the development chamber 20*a* so as to be substantially parallel along the direction of the rotation shaft of the development sleeve 26. The first conveyance screw 21 has a screw structure in which a helical blade made of a non-magnetic material is provided on a rotation shaft, which is a ferromagnetic body, in a circumferential direction. The first conveyance screw 21 rotates to convey the developer along the axial direction of the development sleeve 26.

In addition, like the first conveyance screw 21, the second conveyance screw 22 provided in the stirring chamber 20*b* has the screw structure in which a helical blade made of a non-magnetic material is provided on a rotation shaft, which is a ferromagnetic body, in the circumferential direction, and is disposed on the bottom of the stirring chamber 20*b* so as to be substantially parallel to the first conveyance screw 21. However, the blade is oriented in the direction reverse to the blade of the first conveyance screw 21. The second conveyance screw 22 rotates in the direction same as the first conveyance screw 21 to convey the developer in the stirring chamber 20*b* in the direction reverse to the conveyance direction by the first conveyance screw 21.

In this way, the developer is conveyed, and circulates between the development chamber 20*a* and the stirring chamber 20*b* through communication portions 20*c* provided at both ends of the developer storing portion 20 in the longitudinal direction. At that time, the developer is pushed up from bottom to top due to the pressure of the developer accumulated on the downstream side with respect to the conveyance direction by the second conveyance screw 22, whereby the developer is delivered from the stirring chamber 20*b* to the development chamber 20*a*.

In addition, the development chamber 20*a* has an opening on the position facing the photosensitive drum 1, and the development sleeve 26 serving as the developer bearing member is rotatably mounted to the opening so as to be partially exposed to the photosensitive drum 1. The development sleeve 26 also has, on the position facing the photosensitive drum 1, a development region where the developer is deposited onto the photosensitive drum 1 for development. In addition, it is supposed that the leading end and the trailing end of the development region in the rotation direction of the development sleeve 26 correspond to the leading end and the trailing end of a contact region between the photosensitive drum 1 and the developer on the development sleeve 26 when the image formation is stopped.

Furthermore, the development sleeve 26 has stored therein a magnet roller 25 serving as a magnetic field generating member in a non-rotating state. This magnet roller 25 has a plurality of magnetic poles, and has a development pole S1 on the position corresponding to the development region of the development sleeve 26. That is, the magnetic pole S1 which is the development pole is arranged at the position facing the photosensitive drum 1. In addition, a magnetic pole N1 which is a first magnetic pole and has a polarity opposite to the polarity of the development pole and a magnetic pole N2 which is a second magnetic pole and has a polarity opposite to the polarity of the development pole are provided adjacent to each other across the magnetic pole S1. Thus, the magnet roller 25 includes three types of magnetic poles in the present embodiment.

When the development sleeve 26 rotates in the direction of an arrow X while carrying the developer thereon due to the magnetic force of each magnetic pole, the developer is conveyed to the development region. Specifically, the developer in the development chamber 20*a* is lifted up and carried on the development sleeve 26 by the magnetic pole N2 of the magnet roller 25. In addition, the developer is napped in a brush chain by the magnetic pole S1. Furthermore, the developer is stripped off from the development sleeve 26 due to a repulsive magnetic field formed by the magnetic pole N2 and the magnetic pole N1, and fed back to the stirring chamber 20*b*.

Figure 4:
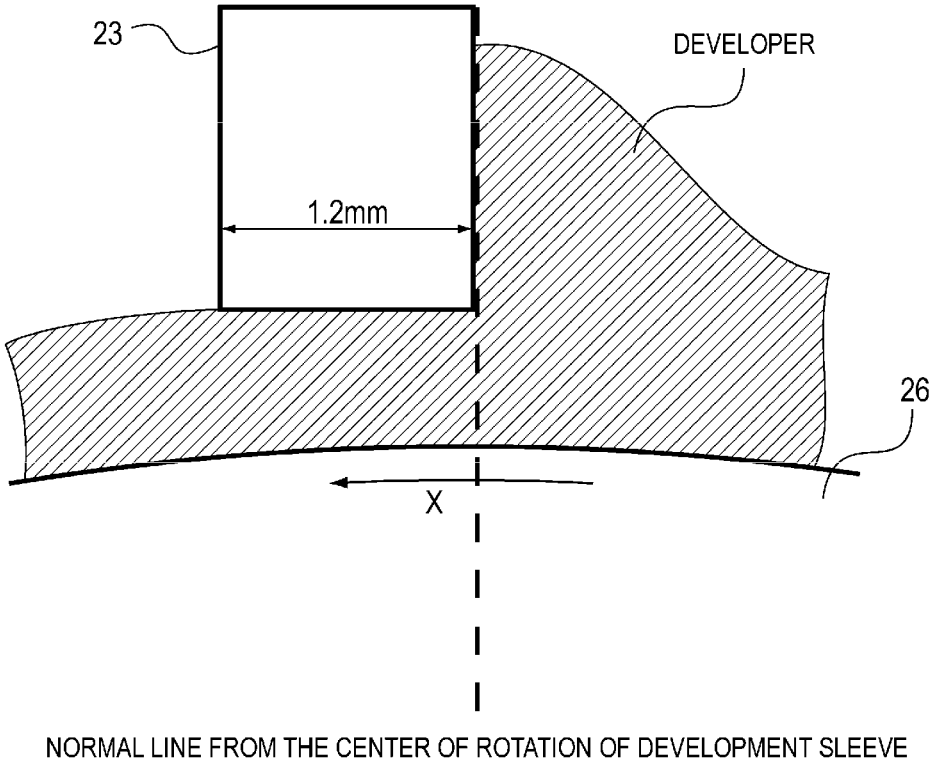
FIG. 4 is a schematic sectional view illustrating the configuration of a development blade.

In addition, a development blade 23 serving as a regulation portion is provided to face the development sleeve 26 in the vicinity thereof. In the present embodiment, as illustrated in FIG. 4, the development blade 23 is a non-magnetic member formed from a sheet-type aluminum with a thickness of 1.2 mm extending along the direction of the rotation shaft of the development sleeve 26. Further, the development blade 23 is configured such that the developer regulation surface extends in the normal direction from the center of the rotation of the development sleeve 26.

The development blade 23 regulates the amount of the developer carried on the development sleeve 26 to form a developer layer with a predetermined thickness on the development sleeve 26. Specifically, the developer carried on the development sleeve 26 passes between the leading end of the development blade 23 and the surface of the development sleeve 26 due to the rotation of the development sleeve 26, by which the amount of the developer is regulated and the developer layer is formed. The developer layer thus formed is conveyed to the development region due to the rotation of the development sleeve 26.

Note that the regulation amount of the developer is set by adjusting the distance between the leading end of the development blade 23 and the surface of the development sleeve 26. In the present embodiment, the gap (hereinafter referred to as SB gap) between the leading end of the development blade 23 and the surface of the development sleeve 26 is set to be 500 μm, and the amount of the developer coating the development sleeve 26 per unit area is set to be 30 mg/cm$^2$. Therefore, the development sleeve 26 is coated with the developer in an amount of at least 30 mg/cm$^2$ when the developer reaches the development blade 23.

The developer layer thus formed is in contact with the photosensitive drum 1 in the development region with the developer being napped by the magnetic force of the magnetic pole S1 serving as the development pole, whereby the developer is supplied to the electrostatic latent image for development.

Notably, during the development, a development voltage obtained by superimposing a DC voltage and an AC voltage is applied to the development sleeve 26 to enhance development efficiency (toner deposition rate to the electrostatic latent image). In the present embodiment, the DC voltage of −500 V and the AC voltage having a peak-to-peak voltage of 800 V and a frequency of 12 kHz are applied. When the AC voltage is applied, the development efficiency is enhanced, but a fog is likely to occur. In view of this, a potential difference is formed between the DC voltage to be applied to the development sleeve 26 and the charging potential (white part potential) of the photosensitive drum 1 to prevent the fog.

In addition, in the present embodiment, the diameter of the development sleeve 26 is set to be 20 mm, the diameter of the photosensitive drum 1 is set to be 60 mm, and the distance between the development sleeve 26 and the photosensitive drum 1 at the position where they are closest to each other is set to be about 300 μm. Further, a blast process is performed on the surface of the development sleeve 26. Therefore, the developer is physically trapped by the irregularities on the surface of the development sleeve 26, whereby strong conveyance force is implemented in the circumferential direction due to the rotation of the development sleeve 26.

Moreover, in the development region, the development sleeve 26 rotates in the rotation direction of the photosensitive drum 1 with the circumferential speed ratio of 1.75 with respect to the photosensitive drum 1. The circumferential speed ratio is set to be 0.5 to 2.5. The larger the circumferential speed ratio is, the more the development efficiency is increased. However, when the circumferential speed ratio is too large, toner scattering or deterioration of the developer is likely to occur. In view of this, it is preferable that the circumferential speed ratio is set to be 1.0 to 2.0.

<Arrangement of Regulation Portion>

Next, the arrangement of the development blade 23 as the regulation portion will be described in detail.

Figure 5:
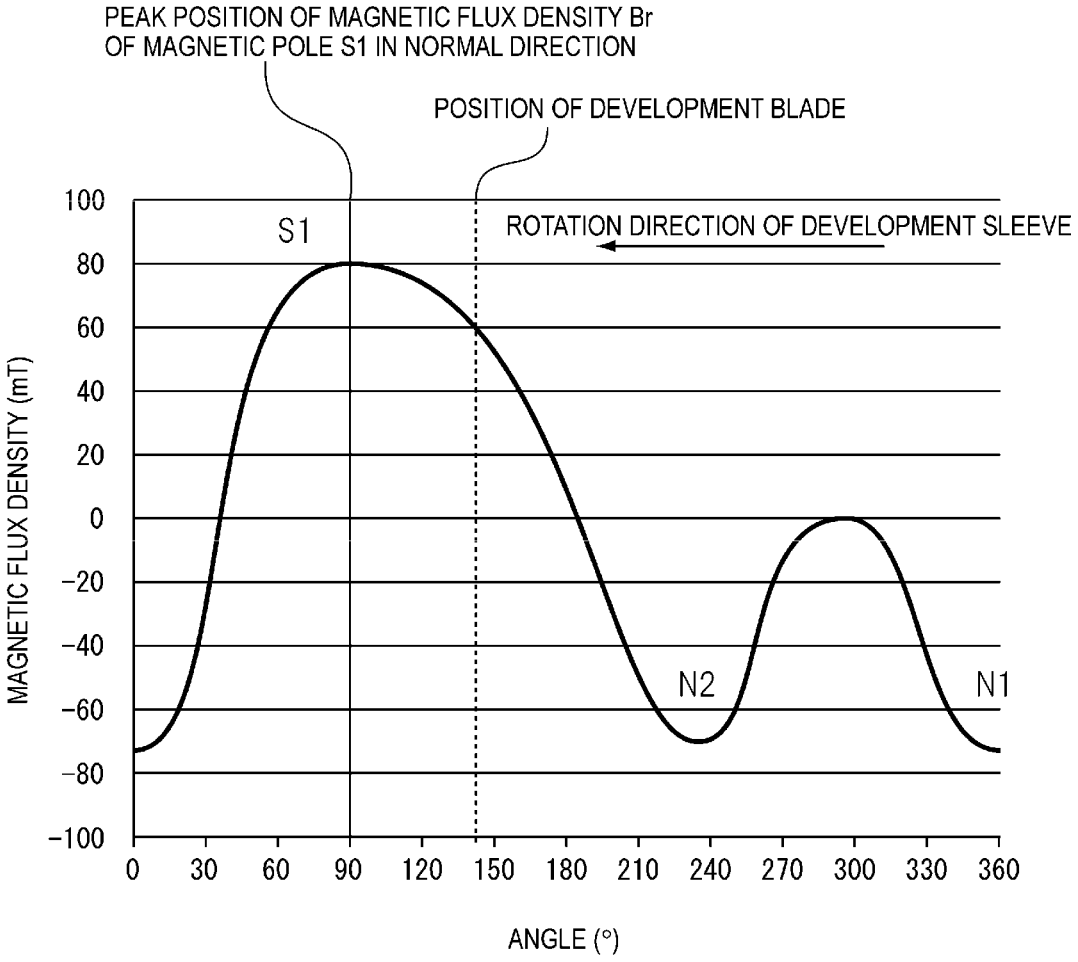
FIG. 5 is a graph illustrating a distribution of a magnetic flux density in the normal direction with respect to the surface of the development sleeve.

FIG. 5 is a graph showing the distribution of a magnetic flux density Br (hereinafter merely referred to as a magnetic flux density Br in the normal direction), exerted from the magnet roller 25, in the normal direction with respect to the surface of the development sleeve 26. In this case, the angle indicated in the horizontal axis in FIG. 5 is set to increase in the clockwise direction (direction opposite to the rotation direction) along the circumferential direction of the development sleeve 26 with the angle just below the rotational center of the development sleeve 26 in FIG. 2 in the vertical direction being defined as 0°. In addition, the magnetic flux density Br in the normal direction is set such that the side on the magnetic pole S1 (development pole) is positive.

As illustrated in FIG. 5, firstly, the magnetic flux density Br on the magnetic pole S1 in the normal direction is configured to have a peak (magnetic flux density Br=80 mT) on the position of 90°, to have a half width of 95°, and to be distributed from 35° to 185° (defined at 0 mT at both ends of the peak). Note that the development region is formed near the position of 90° which is the peak position of the magnetic flux density Br of the magnetic pole S1 in the normal direction.

In addition, the magnetic flux density Br of the magnetic pole N2 in the normal direction is configured to have a peak (magnetic flux density Br=70 mT) at 235° and have a half width of 65°. Further, the magnetic flux density Br of the magnetic pole N1 in the normal direction is configured to have a peak (magnetic flux density Br=70 mT) at 0° and have a half width of 60°.

In this case, the development blade 23 is disposed on the position upstream of the development region where the developer is deposited on the photosensitive drum 1 by the development sleeve 26 and downstream of the position where the magnetic flux density Br of the magnetic pole S1, which is the development pole, in the normal direction becomes zero, with respect to the rotation direction of the development sleeve 26. Specifically, the magnetic pole S1 is arranged such that the development blade 23 is located downstream of the position where the magnetic flux density Br of the magnetic pole S1, which is the development pole, in the normal direction becomes zero, with respect to the rotation direction of the development sleeve 26. According to this configuration, the magnetic flux density can be set to be positive in the entirety of a region which is downstream of the development blade 23 and which is upstream of the development region with respect to the rotation direction of the development sleeve 26. That is, this configuration can make the magnetic flux density positive in the region from the position where the development blade 23 faces the development sleeve 26 in the rotation direction of the development sleeve 26 to the upstream end of the development region in the rotation direction of the development sleeve 26. It is also obvious that the magnetic flux density from the position position where the development blade 23 faces the development sleeve 26 to the downstream end of the development region in the rotation direction of the development sleeve 26 can be set to be positive. In the present embodiment, the development blade 23 is disposed on the position upstream of the development region and downstream of the position of angle 185° where the magnetic flux density Br of the magnetic pole S1 in the normal direction becomes zero, with respect to the rotation direction of the development sleeve 26. More specifically, the development blade 23 is disposed on the position of 145°.

Due to the configuration in which the development blade 23 is disposed on this position, the density of the developer layer carried on the development sleeve 26 can be made uniform.

Figure 6:
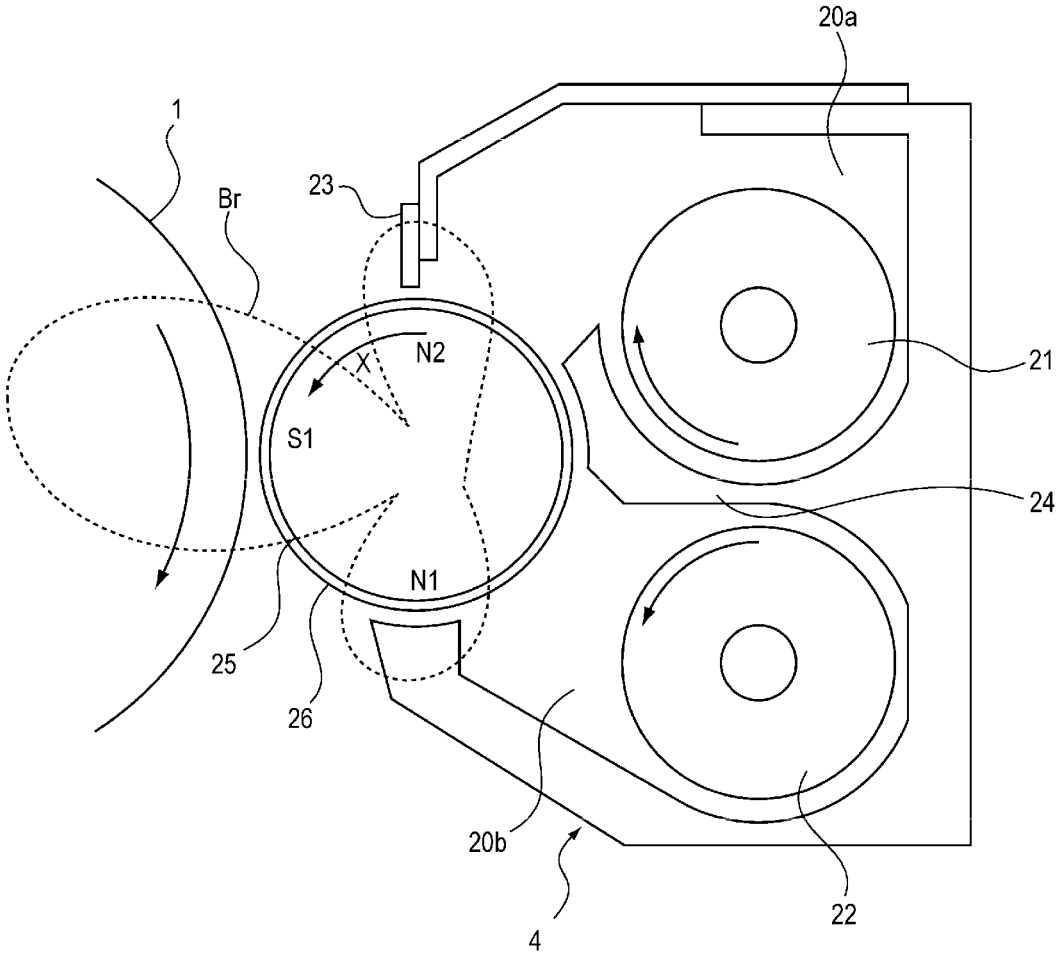
FIG. 6 is a schematic sectional view of a development device in which the development blade is disposed in a region where a magnetic flux density of a magnetic pole N2 in the normal direction is larger than zero.
Figure 7:
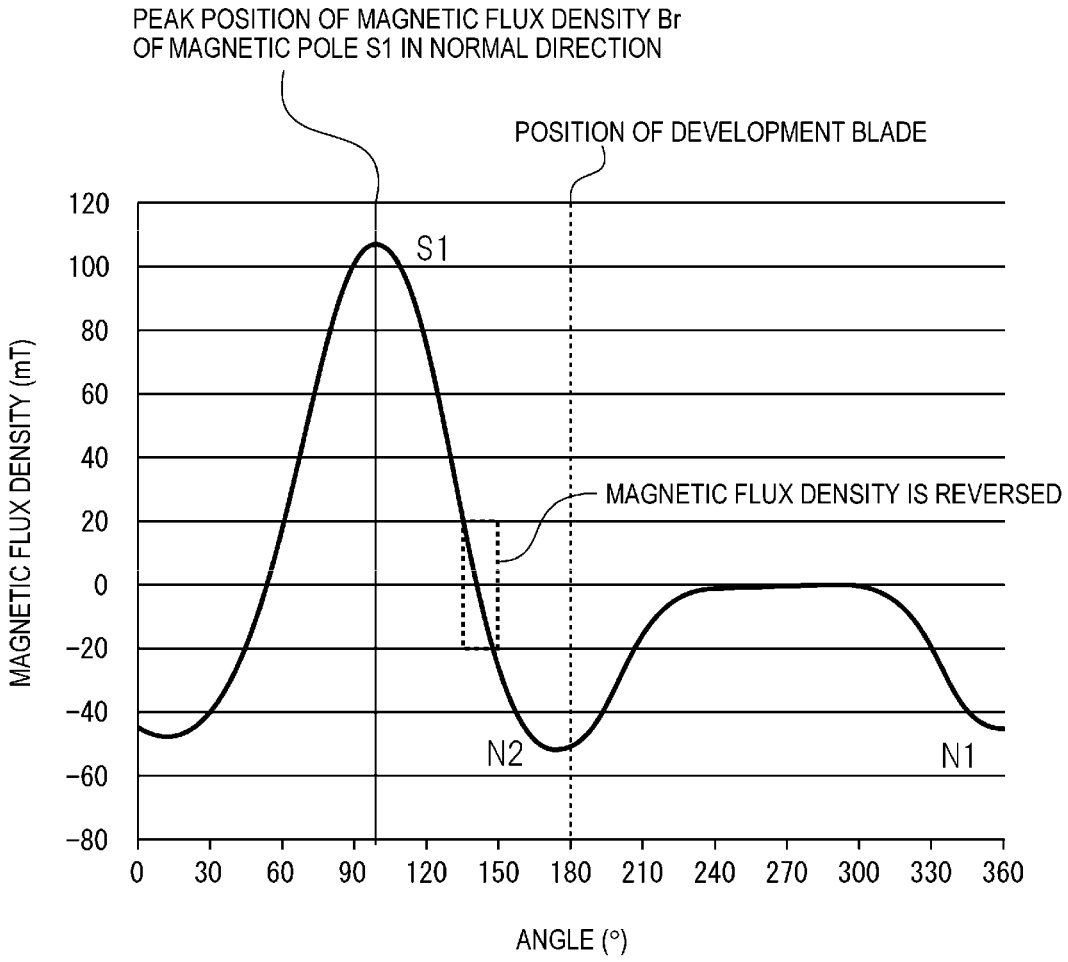
FIG. 7 is a graph illustrating a distribution of a magnetic flux density in the normal direction with respect to the surface of the development sleeve in the development device illustrated in FIG. 6.

Specifically, for example, the development blade 23 is supposed to be disposed in the region where the magnetic flux density Br of the magnetic pole N2, which is different from the magnetic pole S1 serving as the development pole, in the normal direction is larger than zero (in the present embodiment, larger than zero in the negative direction) as illustrated in FIG. 6. In this case, as illustrated in FIG. 7, the developer is subjected to magnetic pole inversion (the magnetic flux density Br in the normal direction is reversed) at least more than once before being conveyed to the development region after being restricted by the development blade 23. When the developer is subjected to the magnetic pole inversion, the magnetized developer is reversed and rearranged, so that the density of the developer layer, which has been made uniform by the development blade 23, is likely to be non-uniform. Therefore, the density of the developer conveyed to the development region is likely to be non-uniform, which is undesirable from the viewpoint of improvement in image quality.

On the other hand, when the development blade 23 is disposed in the region where the magnetic flux density Br of the magnetic pole S1, which is disposed on the position corresponding to the development region, in the normal direction is larger than zero as in the present embodiment, the rearrangement of the developer due to the magnetic pole inversion can be prevented, and thus, the developer having uniform density can be conveyed to the development region. Accordingly, the contact state between the developer layer and the photosensitive drum 1 in the development region is made uniform, whereby image quality can be improved.

Next, more desirable arrangement of the development blade 23 will be described.

Figure 8:
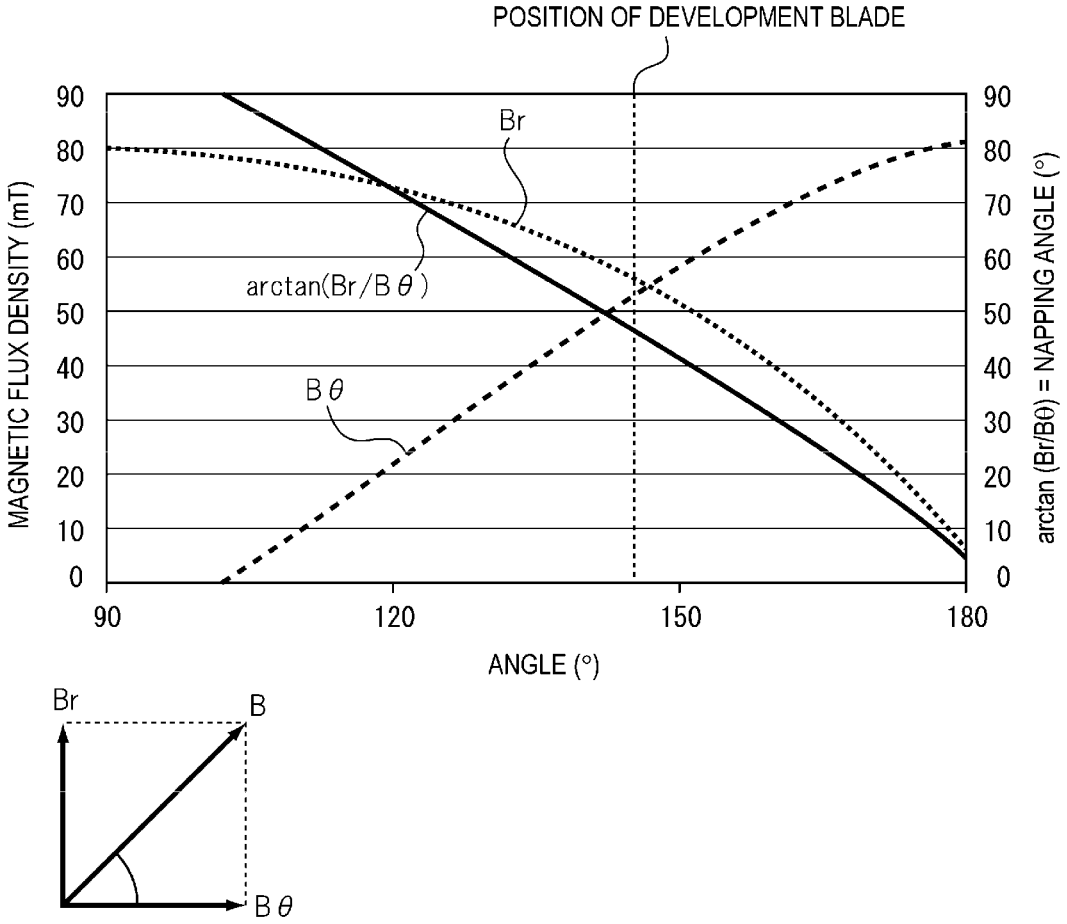
FIG. 8 is a graph showing a magnetic flux density Br in the normal direction, a magnetic flux density Bθ in the tangential direction, and arctan (Br/Bθ), with respect to the surface of the development sleeve.

FIG. 8 is a graph showing the magnetic flux density Br in the normal direction exerted from the magnet roller 25, the magnetic flux density Bθ in the tangential direction, and arctan (Br/Bθ).

In this graph, arctan (Br/Bθ) is an arctangent function of Br which is the normal-direction component of the magnetic flux density B and Bθ which is the tangential-direction component of the magnetic flux density B, and the angle θ to be obtained is an angle of the magnetic flux density B from the tangential direction. Since the developer tends to be napped along the direction of the magnetic flux density, the angle θ of the magnetic flux density B from the tangential direction indicates the napping angle of the developer.

Notably, as for the angle indicated by the horizontal axis in FIG. 8, the angle just below the rotation center of the development sleeve 26 in the vertical direction in FIG. 2 is defined as 0°, and the angle is increased in the clockwise direction (direction opposite to the rotation direction) along the circumferential direction of the development sleeve 26, as in the graph in FIG. 5. In addition, the angle θ of the magnetic flux density B from the tangential direction, that is, the napping angle of the developer, is set such that the angle in the tangential direction opposite to the rotation direction of the development sleeve 26 is defined as 0°.

Figure 9A:
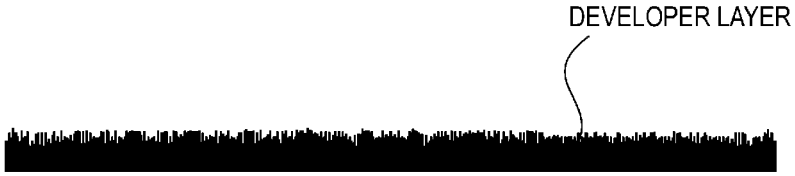
FIGS. 9A and 9B are views of the shape of the developer layer near the region upstream of a position where a magnetic flux density of a magnetic pole S1 in the normal direction has a peak, as observed from the tangential direction of the development sleeve.
Figure 9B:
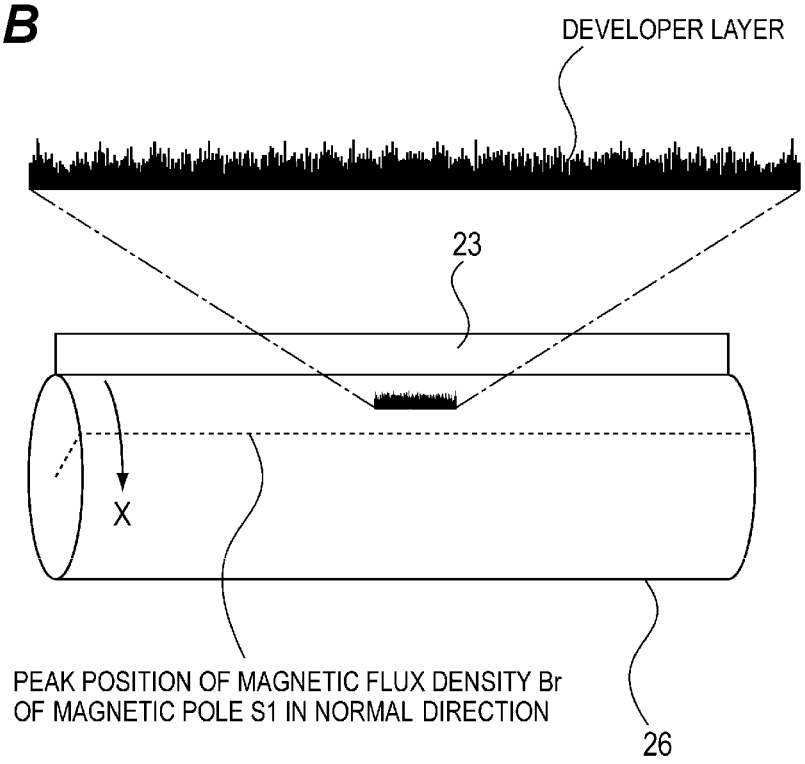

FIGS. 9A and 9B are views of the shape of the developer layer near the region upstream of the position where the magnetic flux density of the magnetic pole S1 in the normal direction has the peak after the developer layer is regulated by the development blade 23, as observed from the tangential direction of the development sleeve 26. FIG. 9A illustrates that the development blade 23 is disposed on the position where arctan (Br/Bθ)=45°, and FIG. 9B illustrates that the development blade 23 is disposed on the position where arctan (Br/Bθ)=10°.

As illustrated in FIGS. 9A and 9B, when the developer is regulated in the region where arctan (Br/Bθ) is small, that is, when the developer laid down on the surface of the development sleeve 26 is regulated, the density of the developer layer after the regulation is more difficult to be made uniform than the case where the developer which is napped in the normal direction is regulated.

This is because, when the developer is regulated while being laid down on the surface of the development sleeve 26, the sensitivity of the developer amount after the regulation with respect to the variation in the SB gap is increased. Therefore, the variation in the SB gap caused by fine irregularities of the shape of the tip of the development blade 23 is undesirably reproduced as variation in the developer amount after the regulation with high sensitivity, and this is not preferable from the viewpoint of making the density of the developer layer uniform.

The state in which the developer is laid down means that the developer is napped in the tangential direction of the surface of the development sleeve 26. Even when the thickness of the developer layer is physically regulated by the development blade 23 with this state, it is assumed that the developer is likely to be attracted in the lateral direction toward the SB gap region from the upstream side of the development blade 23 due to the connection of the developer in the tangential direction. Therefore, variation occurs in the amount of the developer to be conveyed to the SB gap, and thus, it is assumed that the variation occurs in the density of the developer layer at the downstream side of the development blade 23.

For this reason, it is preferable that the development blade 23 is disposed in the region where arctan (Br/Bθ) is large, that is, in the region where the developer is napped in the normal direction as much as possible with respect to the surface of the development sleeve 26. Specifically, the development blade 23 is preferably disposed in the region where the napping angle is larger than at least 20°, and more preferably disposed in the region where the napping angle is larger than or equal to 45°. That is, the development blade 23 is preferably disposed in the region where arctan (Br/Bθ)>20°, and more preferably disposed in the region where arctan (Br/Bθ)≥45°. According to this configuration, the density of the developer layer to be conveyed to the development region can be made more uniform.

<Experimental Result>

Next, the result of an experiment conducted for comparing, between the configuration of the present embodiment and configurations of comparative examples, the state of the density of the developer layer to be conveyed to the development region and image quality (degree of roughness) when a halftone image is output will be described with reference to the table in FIG. 10.

In the table in FIG. 10, the comparative example A has the configuration in which the development blade 23 is disposed upstream of the development region, downstream of the position where the magnetic flux density Br of the magnetic pole S1 serving as the development pole in the normal direction becomes zero, and on the position where the napping angle of the developer is 20°. In addition, the configuration similar to the configuration of the comparative example A except that the development blade 23 is disposed on the position where the napping angle is 10° is defined as the comparative example B. In addition, the configuration in which the development blade 23 is disposed in the region where the magnetic flux density Br of the magnetic pole N2 in the normal direction is larger than zero is defined as the comparative example C (the configuration illustrated in FIG. 6). Note that, in this experiment, the SB gap is adjusted so that the coating amount of the developer after the regulation by the development sleeve 26 becomes 30 mg/cm$^2$, and the type of the developer is the same as that in the present embodiment.

The image quality when a halftone image is output is ranked as image quality ranks by visual evaluation, wherein a circle mark indicates good, a triangular mark indicates at least allowable, and an X mark indicates not allowable. As for the state of the density of the developer layer, the variation in the height of the developer layer illustrated in FIGS. 9A and 9B is similarly ranked as a density rank.

The result of the experiment shows that the configuration of the present embodiment provides the highest level in the image quality rank and in the density rank both under a normal environment and in a high-humidity environment in which the deterioration in roughness is easy to be visible, as illustrated in the table in FIG. 10. In contrast, as for the configurations of the comparative examples, the image quality rank and density rank are lowered in the order of the comparative examples A, B, and C.

It is apparent from the result of the experiment that, according to the configuration of the present embodiment, the density of the developer layer is made uniform, and a satisfactory image with less roughness can be obtained.

While the present embodiment describes the configuration in which the magnet roller 25 has three magnetic poles, the present invention is not limited thereto. A magnet roller having five or seven magnetic poles may be used. However, to dispose the development blade 23 in the region where the magnetic flux density of the development pole in the normal direction is larger than zero, a space for a mechanical configuration is required, and the wider the development pole is, the more the degree of freedom in the configuration is increased. Therefore, it is preferable to use a magnet roller having three magnetic poles in total, by which the development pole is easy to be widened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-080908, filed Apr. 14, 2016, which is hereby incorporated by reference herein in its entirety.

What is claimed is:

1. A development device, comprising:

a developer bearing member which is configured to be rotatable and bear developer containing toner and carrier for carrying the developer to a developing area facing an image bearing member;

a magnet which is fixed inside of the developer bearing member, the magnet comprising a first magnetic pole for developing a latent image formed on the image bearing member, a second magnetic pole disposed adjacent to the first magnetic pole in a rotary direction of the developer bearing member and having an opposite pole to the first magnetic pole, and a third magnetic pole disposed adjacent to both the first magnetic pole and the second magnetic pole in the rotary direction of the developer bearing member and having an opposite pole to the first magnetic pole, and a regulation portion which is disposed to face the developer bearing member without contacting the developer bearing member and regulates an amount of developer borne by the developer bearing member, wherein the regulation portion is disposed such that, when a maximum peak amount of a magnetic flux density of the first magnetic pole in a normal direction of the developer bearing member is defined as positive, the magnetic flux density of the first magnetic pole in the normal direction of the developer bearing member becomes positive in an entire region from a downstream side of the regulation portion in the rotary direction of the developer bearing member and through the developing area.

2. The development device according to claim 1, wherein the regulation portion is disposed at a downstream side in a rotary direction of the developer bearing member from a position where the magnetic flux density of the first magnetic pole in the normal direction of the developer bearing member becomes zero.

3. The development device according to claim 1, wherein the regulation portion is disposed such that, when a maximum amount of a magnetic flux density of the first magnetic pole in the normal direction of the developer bearing member is defined as positive, the magnetic flux density of the first magnetic pole in the normal direction of the developer bearing member in an entire region from a downstream side of the regulation portion in the rotary direction of the developer bearing member and through the developing area is more than half of a maximum amount of the magnetic flux density of the first magnetic pole in the normal direction of the developer bearing member.

* * * * *